United States Patent [19]

Totten et al.

[11] Patent Number: 4,836,951

[45] Date of Patent: Jun. 6, 1989

[54] RANDOM POLYETHER FOAM CONTROL AGENTS

[75] Inventors: George E. Totten, West Haverstraw; Gordon C. Johnson, Armonk, both of N.Y.

[73] Assignee: Union Carbide Corporation, Danbury, Conn.

[21] Appl. No.: 23,231

[22] Filed: Mar. 9, 1987

Related U.S. Application Data

[63] Continuation of Ser. No. 830,762, Feb. 19, 1986, abandoned.

[51] Int. Cl.[4] ..... C11D 1/722

[52] U.S. Cl. ..... 252/174.21; 252/94; 252/174.22; 252/187.21; 252/DIG. 1; 568/606

[58] Field of Search ..... 252/174.21, 174.22, 252/135, 99, DIG. 1, 94; 568/606, 614, 616, 622, 624, 625

[56] References Cited

U.S. PATENT DOCUMENTS

| | | | |
|---|---|---|---|
| 2,674,619 | 4/1954 | Lundsted | 260/485 |
| 2,677,700 | 5/1954 | Jackson et al. | 260/488 |
| 3,101,374 | 8/1963 | Patton, Jr. | 260/584 |
| 3,359,207 | 12/1967 | Kaneko et al. | 252/99 |
| 3,504,041 | 3/1970 | Weipert | 260/615 |
| 3,629,127 | 12/1971 | Palmer et al. | 252/55 |
| 3,635,827 | 1/1972 | Jakobi | 252/89 |
| 3,941,710 | 3/1976 | Gilbert et al. | 252/99 |
| 3,956,401 | 5/1976 | Scardera et al. | 260/615 B |
| 4,001,132 | 1/1977 | Maguire, Jr. | 252/105 |
| 4,070,298 | 1/1978 | Scardera et al. | 252/89 R |
| 4,188,305 | 2/1980 | Halas | 252/95 |
| 4,203,858 | 5/1980 | Chakrabarti | 252/135 |
| 4,263,160 | 4/1981 | Morse | 252/174.16 |
| 4,272,394 | 6/1981 | Kaneko | 252/99 |
| 4,280,919 | 7/1981 | Stoeckigt et al. | 252/135 |
| 4,288,639 | 9/1981 | Camp | 568/625 |
| 4,299,994 | 11/1981 | Stahel | 568/625 |
| 4,306,987 | 12/1981 | Kaneko | 252/99 |
| 4,317,940 | 3/1982 | Scardera et al. | 568/625 |
| 4,381,205 | 4/1983 | Warchol | 148/18 |
| 4,411,810 | 10/1983 | Dutton et al. | 252/99 |

FOREIGN PATENT DOCUMENTS

| | | |
|---|---|---|
| 2250937 | 4/1974 | Fed. Rep. of Germany . |
| 1592203 | 7/1981 | United Kingdom . |

*Primary Examiner*—A. Lionel Clingman
*Assistant Examiner*—Hoa Van Le
*Attorney, Agent, or Firm*—Gerald L. Coon

[57] ABSTRACT

Improved mechanical dishwasher formulations are provided which are characterized by the use of a random copolyether foam control agent, and wherein the foam control agent imparts the desirable properties of cleaning and defoaming without the concurrent buildup of spots and films on the dishes. The foam control agent is a copolyether having a molecular weight of at least about 2000 and containing random propyleneoxy (and/or butyleneoxy) groups and ethyleneoxy groups. The amount of ethyleneoxy and propyleneoxy or butyleneoxy groups present in the copolyether is selected such that the cloud point of the foam control agent is equal to, or less than, the operating temperature of the mechanical dishwasher.

29 Claims, No Drawings

RANDOM POLYETHER FOAM CONTROL AGENTS

This is a continuation of prior U.S. application Ser. No. 830,762 filed on Feb. 19, 1986 now abandoned.

FIELD OF THE INVENTION

This invention relates in general to random polyether compositions having foam control and surfactant properties. In one aspect, this invention relates to mechanical dishwasher formulations containing random polyether foam control agents. In a further aspect, this invention is directed to random polyether copolymers which are particularly useful in mechanical dishwasher formulations and which impart desirable properties of cleaning and defoaming without a concurrent build-up of spots or films on the dishes.

BACKGROUND OF THE INVENTION

Prior to the present invention a variety of surfactants are disclosed in the literature which are indicated to be suitable for use in mechanical dishwasher formulations. Many of the surfactants disclosed are block polyalkylene oxide copolymers of long chain alkyl started alkoxylates. For example, U.S. Pat. No. 2,677,700 which issued May 4, 1954 and is assigned to Wyandotte Chemicals Corporation discloses and claims certain polymers anionic and nonionic surface active agents in which the essential hydrophobic element is a polyoxyalkylene chain of a prescribed minimum length. It is indicated in the patent that both the hydrophobic and hydrophilic elements can be simultaneously varied both as to the molecular weight and type to prepare a "tailored" surface active agent.

In U.S. Pat. No. 2,674,619 which issued Apr. 6, 1954 and is also assigned to Wyandotte Chemicals Corporation there is disclosed a new class of polyalkyleneoxy compositions which are indicated to have outstanding detergent and surface active properties. Such polyalkyleneoxy compositions are prepared by first condensing propylene oxide with an organic compound having a plurality of reactive hydrogen atoms to prepare a polyoxypropylene polymer of at least 900 molecular weight, and subsequently condensing ethylene oxide therewith.

There is also disclosed in U.S. Pat. No. 4,134,854 which issued to Texaco Development Corporation on Jan. 16, 1979, surfactants wherein the pour point can be lowered by the addition of alkylene oxides. In the process disclosed in this patent, ethylene oxide, propylene oxide and ethylene oxide are added sequentially to alcohols.

Other surfactants are disclosed in the literature which have been indicated to be useful in dishwasher formulations and which have various desirable properties, such as low cloud points, excellenet defoaming characteristics and the like. However, for the most part these references are directed to surfactants which are either prepared from block copolymers as opposed to random copolymers or which rely upon the addition of a second or third component to make up for the deficiencies of the surfactant.

In this regard, see for example, U.S. Pat. No. 3,629,127 which discloses and claims the use of nonionic surfactants such as oxyalkylated linear alcohols in addition to an auxiliary defoamant, for example, an anionic phosphate ester of oxyalkylated alcohols. In a similar fashion, in U.S. Pat. No. 3,635,827 low foam dishwasher detergent surfactants are prepared by utilizing alkoxylates of fatty alcohols in combination with polyvinyl alcohol. In U.S. Pat. Nos. 3,941,710, 4,001,132, and 4,203,858, there are disclosed various combinations of polymeric compounds and additives to achieve desired properties in the surfactants disclosed and claimed.

U.S. Pat. No. 3,359,207 which was issued Dec. 19, 1967, describes the use of block copolymers of ethylene and propylene oxide and block copolymers derived from various starters such as pentaerythritol, ethanol, ethylene diamine, octanol and the like. Similar ethylene oxide/propylene oxide block copolymers, which use branched 1-decanols as starters are also described in U.S. Pat. No. 4,299,994. Other patents such as U.S. Pat. Nos. 3,101,374, 4,306,987 and 4,411,810 disclose various block-heteric copolymers which are useful as surfactants.

Additives for automatic dishwasher detergent formulations comprising PO/EO/PO block copolymers in combination with an alkyl phosphate ester are also described in U.S. Pat. Nos. 4,070,298 and 4,263,160. It is indicated that such additives are useful in automatic dishwasher formulations to accomplish defoaming.

U.S. Pat. No. 4,272,394 describes blends of low foaming nonionic surfactants which are replacements for the alkyl phosphate ester defoamants of conventional automatic dishwashing detergents. Such blends comprise a conventional low foaming nonionic surfactant and a block-heteric copolymer of ethylene oxide and a lower alkylene oxide such as propylene or butylene oxide. The conventiona low foaming nonionic surfactant is a polyoxyalkylene adduct of a hydrophobic base wherein the oxygen/carbon atom ratio in the oxyalkylene portion of the molecule is greater than 0.40, and is prepared from, e.g., ethylene oxide or mixtures with minor amounts of propylene oxide, butylene oxide, etc. In this regard, see, e.g., column 2, lines 45+, as well as column 6, lines 64+.

As can be seen from the foregoing, the literature relating to the use of ethylene oxide/propylene oxide copolymers as surfactants for mechanical dishwasher detergents discloses, for the most part, nonionic surfactants which contain three possible configurations. First, the ethylene oxide/propylene oxide is a block configuration, that is, either EO/PO/EO or PO/EO/PO. Second, the ethylene and propylene oxide are reacted with alcohol starters having eight or more carbon atoms. Finally, heteric copolymers containing ethylene or propylene oxide can be used if in a block heteric form. Copolymers, such as these are formed by preparing a random copolymer with two regions where the EO/PO random mixture is adjusted to prepare a relatively hydrophilic and a relatively hydrophobic region.

SUMMARY OF THE INVENTION

In its broad aspect, the present invention is directed to novel mechanical dishwasher formuations containing certain random polyether foam control agents. The formulations have low foaming properties and leave a minimum of spotting and filming on articles washed in the presence of such random polyether foam control agents. The formulations of the present invention are comprised of a foam controlling amount of a foam control agent comprised of a copolyether having a molecular weight of at least about 2000, and containing random propyleneoxy (and/or butyleneoxy) and ethyleneoxy groups, wherein the ethyleneoxy groups are present in an amount of at lesat about 20 percent by weight of the polyether component of the copolymer, and wherein said propyleneoxy (and/or butyleneoxy) groups are present in an amount such that the cloud point is equal to, or less than, the operating temperature of the mechanical dishwasher.

DETAILED DESCRIPTION OF THE INVENTION

As herein before indicated, the copolyether foam control agents of the present invention which are employed in the mechanical dishwasher formulations are random copolymers, specifically copolyethers which have the molecular weights and ethyleneoxy group content as indicated above.

The random copolyether foam control agents of the present invention can be illustrated by the following formulae:

$$RO(C_2H_4O)_x(CH_2\underset{\underset{R'}{|}}{C}HO)_yX \qquad \text{I}$$

$$XO(C_2H_4O)_x(CH_2\underset{\underset{R'}{|}}{C}HO)_y(CH_2\underset{\underset{R}{|}}{C}HO)_zX \qquad \text{II}$$

$$ZO(CH_2\underset{\underset{\underset{Z}{|}}{O}}{C}HCH_2O)_{w/2}[(C_2H_4O)_x(CH_2\underset{\underset{R'}{|}}{C}HO)_y(CH_2\underset{\underset{R''}{|}}{C}HO)_z]-(CH_2\underset{\underset{\underset{Z}{|}}{O}}{C}HCH_2O)_{w/2}Z \qquad \text{III}$$

$$A(OCH_2\underset{\underset{\underset{Z}{|}}{O}}{C}HCH_2OZ)_n \qquad \text{IV}$$

wherein R is derived from a saturated or unsaturated alcohol having up to 36 carbon atoms, such as a $C_{12}$ to $C_{18}$ primary alcohol, or an alkylaryl group such as a $C_1$ to $C_{16}$ substituted phenol; R′ is a methyl or ethyl group; R″ is an alkyl group having from 3 to 36 carbon atoms, or an alkylaryl group such as a $C_1$ to $C_{16}$ substituted phenol; x and y are integers selected in any ratio such that the final polyether does not contain more than 75 weight percent of ethylene oxide; z is an integer of from 0 to 4; X is hydrogen, chloro, alkyl of from 1 to 24 carbon atoms, alkylaryl such as benzyl, a beta-hydroxy alkyl group, an alkylcarbonyl group such as $C_2$ to $C_{18}$ alkylcarbonyl group or an arylcarbonyl group such as a benzoate group; w has a value of from 2 to 40; Z is:

$$[O(C_2H_4O)_{x'}(CH\underset{\underset{R'}{|}}{C}HO)_{y'}(CH_2\underset{\underset{R''}{|}}{C}HO)_{z'}X]$$

wherein R′ and X are defined as above; x′ and y′ are integers selected such that the sums of (x′ +x) and (y′+y) are such that the polyether does not contain more than 75 percent by weight of ethylene oxide; z′ is an integer of from 0 to 15; A is the residue of an alcohol having a hydroxy functionality of from 1 to 6, such as ethylene glycol, glycerol, trimethylol propane, pentaerythritol, sorbitol, saturated or unsaturated alcohols of up to 36 carbon atoms, etc.; and n is integer of from 1 to 6.

In the above formulae R is preferably derived from an aliphatic hydrocarbyl alcohol of 12 to 18 carbon atoms, or a $C_1$ to C'hd 16 substituted phenol; R′ is methyl or ethyl; R″ is propyl, butyl, octyl, nonyl, dodecyl, as well as various other $C_3$ to $C_{36}$ alkyl groups; and X is hydrogen, benzyl, benzoate, butoxy, acetoxy or $C_1$ to $C_{24}$ alkyl such as methyl, ethyl, etc.

Particularly preferred copolyethers for use in the instant mechanical dishwasher formulations are those of formula I wherein X is hydrogen, R is derived from a $C_{12}$ to $C_{18}$ primary alcohol or nonylphenol, R′ is methyl, the ration of x to y ranges from 40:60 to 50:50, and the molecular weight is at least 4000. Also particularly preferred are those copolyethers of formula II wherein X is hydrogen, R is derived from a $C_{12}$ to $C_{18}$ primary alcohol or nonylphenol, R′ is mehtyl or ethyl, z is preferably 1–2, and the molecular weight is preferably at least 4000.

For the purposes of the present invention, the molecular weights specified herein are weight average molecular weights, $\overline{MW}$, determined by gel permeation chromatography.

The copolyethers of formulae I, II and IV may be prepared by alkoxylation techniques well known to those skilled in the art. The preparation of the copolyethers of formula III is described in detail in copending commonly assigned U.S. patent application Serial No. 641,640, filed Aug. 17, 1984 in the names of Meschke et al., the entirety of which is hereby incorporated by reference and relied on in its entirety.

In practice, it has been found that the copolyethers of the formulae I to IV which have molecular weights of above 2000 are particularly well suited for use in the formulations of the present invention. Preferably, the molecular weight is between about 4500 and about 30,000, although with the copolyethers of formula III, useful molecular weights may range up to as much as 250,000. It has also been found, as hereinafter indicated, that the number of ethylene oxide groups in the foam control agents is important to achieve all of the desired properties in the detergents. For dishwashers operated at about 135° F., for example, polyethers comprised of at least 20 weight percent of ethylene oxide groups and more preferably between about 25 and 60 percent are preferred, with ethylene oxide contents of 25 to 50 weight percent being particularly preferred. As indicated previously, the propyleneoxy (and/or butyleneoxy) groups are present in an amount such that the cloud point is equal to, or less than, the operating temperature of the mechanical dishwasher. At dishwasher operating temperatures below 135° F., the preferred ethylene oxide content will generally decrease, but still be within the range of 25–50 percent by weight. At dishwasher operating temperatures above 135° F., for example in the range of 160° to 170° F., the preferred ethylene oxide content will generally increase, but will generally be in the range of from 25–60% by weight.

The cloud point of the foam control agents of the present invention is determined by methods known in the literature. In the present application the cloud point was determined according to accepted techniques on a one percent aqueous solution of the copolyether.

In general, the operating temperature of mechanical dishwashers can vary over a wide range and if not equipped with adequate temperature controls is usually dependent upon the temperature of the water entering the washer. In practice, however, the temperatures of mechanical dishwashers usually vary from a low of 90° to 100° F. to a high of 160° to 170° F. Mechanical dishwashers which are employed for industrial application, such as in hotel, hospitals, restaurants or the like, usually operate at temperatures of from about 140° F. to about 160° F. Mechanical dishwashers which are used in the home are usually operated at temperatues of from about 120° F. to about 140° F. Thus the particular temperature at which the dishwasher operates will effect the cloud point. As noted above, for dishwashers operating in the range of 120 to 140° F., particularly preferred copolyethers will contain from about 25 to 60% by weight of ethylene oxide. For dishwashers operating at 140° to 160° F., the preferred copolyethers will also possess an ethylene oxide content within this range, although generally at the higher end thereof.

In studying the scope and limitations of the use of various polyether compositions in mechanical dishwasher detergent formulations, the effect of hydrophilicity (ethylene oxide or hydroxyl content) and molecular weight was observed.

The foam test data set forth in the Tables shows that there is an optimum region of ethylene oxide content. For example, the best results were obtained (with a dishwasher operating temperature of 135° F.) with polyether copolymers containing 50 percent by weight of ethylene oxide, while 100 percent propylene oxide containing fluids exhibited only marginal defoamant activity. Interesentingly, higher levels of ethylene oxide content, for example, over 75 percent up to 100 percent of ethylene oxide exhibited almost no defoamant activity. It should also be noted that increasing the hydroxyl content of 100 percent propylene oxide polyethers had essentially no effect.

In addition to an optimal ethylene oxide content there is also a threshold molecular weight, below which there is essentially no defoamant action. The data presented in the Tables shows that this threshold value is approximately 2000 for both 100 and 50 percent propylene oxide containing fluids. Once this threshold has been achieved certain copolyethers continue to improve in defoamant properties.

A second property of interest is the spotting and filming index. It has been noted that while a 100 percent propylene oxide containing fluid may exhibit some defoamant activity, it does not possess any significant spotting and filming inhibition properties. Conversely, the results obtained for 50 percent ethylene oxide containing fluids showed that the spotting and filming index improves with the increasing molecular weight. Hence, it was found that some level of ethylene oxide content is required to achieve both optimal defoamant and spotting and filming inhibition properties.

Once the optimum composition of the copolyethers of this invention was determined it was noted that the random copolyethers had a wide range of unexpected and desirable properties in a single polymeric structure. For example, in addition to the aformentioned features, it has been observed that copolymers prepared with a nonylphenol starter also exhibit an enhanced stabilizing effect on the chlorine containing component of mechanical dishwasher detergents.

The copolyether agents of the present invention, as indicated above, are employed in place of known surfactants presently used in dishwasher formulations, such as, detergents, and impart desirable properties not heretofore available in a single composition. It should be noted that organic compound such as those of the present invention which have random segments of mixed lower alkylene oxides attached to a hydrophobic moiety were not recognized in the literature as being useful as foam control agents. For example, in U.S. Pat. No. 4,445,971 which was issued to S. C. Lappi on May 1, 1984 methods for foam inhibition are disclosed. However, it is specifically disclosed at column 3, lines 11–20, that compositions wherein ethylene oxide and propylene oxide appear as random segments are not useful as defoamants. Hence, if anything the prior art specifically teaches away from the use of polyethers having random alkylene oxide segments as foam control agents.

The term "mechanical dishwasher formulation(s)", as employed throughout the specification and appended claims is intended to include detergents, whether in the form of powders, granules, gels, slurries, or liquids; solid or liquid rinse compositions; or other additives or compounds normally employed with commercial or household mechanical dishwashers to aid in the cleaning of dishes, silverware, stainless steelware, pans and other utensils.

In general, the foam control agents of the present invention will be employed in an amount sufficient to effect optimum defoaming and also provide the other desirable characteristics of spotting and cleaning properties noted above. Thus, the foam control agents can be employed in a "foam controlling amount" to achieve their intended purpose. Generally, the copolyethers will be employed in the formulation in an amount of from about 0.01 to 50 percent by weight depending on the particular end-use, i.e., detergent, rinse aid, etc. For normal residential detergent applications, the copolyether will usually be present in an amount of from 0.01 to 5 percent by weight, and preferably from 1 to 5 weight percent and most preferably from 2 to 5% by weight in order to maximize antifoaming and surfactant properties.

The foam control agents of the present invention can be used in combination with other surfactants, such as nonionic, cationic or anionic surfactants when it is desired to have the added effect of these surfactants and low foaming. These foam control agents can also be blended with one or more other agents encompassed by formulae I–IV above. When employed in combination with the random copolyethers of this invention, such other surfactants may be present in any amount provided that the cloud point of the formulation remains below the operating temperature of the dishwasher. Experiments to date suggest that best results are obtained when such auxiliary surfactants preferably comprise less than 25 weight percent of the total amount of surfactant in the formulation.

It has been observed that the foam control agents of the present invention are particularly attractive for use in mechanical dishwasher detergents. Detergents that are used in commerical or household mechanical dishwashers come in a variety of forms, including powders, liquids, slurries, gells, and the like. However, for the most part, commercially available detergents which can be used in the home or restaurants, are usually comprised of detergent builders, a compound containing active chlorine or available oxygen and one or more surfactants. Other components such as extenders or fragrances are usually employed. A typical detergent may contain from 90 to about 95 weight percent or one or more builders, from about 0.5 to about 5.0 weight percent of a compound containing active chlorine, and 0.01 to about 5.0 weight percent of a surfactant. The copolyether foam control agents of the present invention are used in place of the surfactants, and even when used alone, provide a detergent composition having the aformentioned properties.

A wide variety of builders can also be used in the detergents of the present invention. For example, suitable builders include, among others, the phosphates and the pyrophosphates; the silicates; and other commercially available builders.

In addition to the builders, it may also be desirable to include compounds which contain chlorine in the active form and liberate hypochlorites during the washing process. Illustrative compounds which can be used as a source of chlorine include such compositions as chlorinated trisodium phosphate, sodium and potassium dichlorocyanurates, dichlorocyanuric acid, and 5,5-dimethyl hydantion, trichloromelamine, N-chlorosuccinimide, N-chloroacetyl urea, N,N'-dichlorobiuret chlorinated dicyandiamide, sodium hypochlorite, calcium hypochlorite, and the like.

Other ingredients can also be added if desired to the detergent compositions of the present invention. For example, if a source of available chlorine is not used it might be desirable to add an enzyme material to the composition. Other materials such as china protecting agents, filler material, dyes, perfumes and the like can be utilized in the detergents of the present invention if desired. Accordingly, such compounds as sodium or potassium aluminosilicates, aluminiates, sodium chloride, sodium sulfate, sodium benzene sulfonate, sodium toluene solufonate and the like can be incorporated into the dishwasher detergent composition.

The copolyether foam control agents employed in the mechanial dishwasher detergents of the present invention can be prepared by a variety of methods known in the art. For example, the polyethers can be synthesized by potassium-catalyzed alkoxylation reactions using starting alcohol compounds, such as butanol, dodecanol octadecanol,nonylphenol and the like. Other known alkoxylation methods such as acid catalyzed reactions can be employed.

Although there are numerous tests that are often used for the testing of detergents it is well known that two of the most important criteria of an acceptable mechanical dishwashing surfactant are superior foam control and a low propensity for spotting and filming of dishes after multiple washing cycles. These tests have been employed in the evaluation of the copolyethers of the present invention and are more fully described in the examples. For instance, Example 1 describes the foam reduction character of a surfactant under typical dishwashing conditions. The value is given as a ratio percent. Values of 30–40 are typically observed when no defoamant is employed. Values less than 30 represent a profoamer, 60–70 would be acceptable to the industry and 90–100 are indicated to be excellent. A value of 100 would mean that the amount of foaming observed is the same as water itself.

The test procedure for determining the amount of spotting and film build-up on dishes during repeated use of the detergent is described in Example 1. This test is a particularly critical parameter since very noticeable film build-up can be observed after only seven cycles when no surfactant is used. A value of $<2$ would represent a good candidate. Experience has demonstrated that differences of 0.3 units are significant.

The performance of a detergent formulation without a surfactant is shown in Table 1 where completely unacceptable foam and spotting and filming properties were observed. In fact, complete filming of the dishes was observed in less than the normal ten cycles for the test. These results are in marked contrast to those illustrated for the better candidates shown in subsequent tables.

While the present invention is directed to the use of the random polyether foam control agents in mechanical dishwasher detergent compositions, these agents can also be used for other applications where foam control is also desired. Many fluids when used either alone or in combination with other components possess undesirable foaming properties during chemical processing procedures and hence the use of a foam control agent may be desired. In such instances it may be desirable to employ a foam controlling amount of the copolyethers disclosed in the present invention.

The following examples illustrate the best mode presently contemplated for the practice of the present invention. As noted above, the molecular weight specified in the following examples comprise weight average molecular weights, $\overline{MW}$, as determined by gel permeation chromatography.

EXAMPLE 1

Test for Surfactant Foam Control

Into the lower rack of a Whirlpool 440 model mechanical dishwasher was charged six 9-inch plates distributed evenly. In the upper rack, 12 (10–12 oz.) glass tumblers were placed 6 on each side. Six each of knives, forks and spoons were evenly distributed in the silverware rack.

Using clean dishes and no soil, 2 dishwashing cycles were performed to check the temperature (135°±5° F.) and to record the r.p.m. of the spray arm during the wash cycles. The rotor r.p.m. was clocked three times during the 7 minute wash cycle; after 3 minutes, 4 minutes and 5 minutes. In each use, the r.p.m. was clocked for 30 seconds and multiplied by 2.

The two wash cycles, conducted in the absence of any detergent served a dual purpose: to bring the working machine up to temperature and to provide a standard r.p.m. for water alone.

A 20 gram sample of the detergent powder (2% surfactant, and 32,7% each of sodium tripolyphosphate, sodium meta silicate and sodium carbonate) was introduced into the bottom of the machine near the water inlet and the wash cycle repeated, temperature and r.p.m recorded as above.

After this step the procedure is repeated using 10 grams of soil (5 gm of powdered egg solids and 5 gm of nonfat dry milk) to test the defoaming ability of the detergent.

At least one, preferably two, wash cycles were run without detergent and were run after each test to rinse out the machine completely and to recheck the r.p.m.

for water alone. The ratio % is indicative of low foam or defoaming behavior of the surfactant and is calculated as follows:

$$\frac{\text{r.p.m. with detergent}}{\text{r.p.m. with water}} \times 100 = \text{Ratio } \%$$

(Reference Chemical Specialities Manufacturing Association Bulletin No. 164-60, Subcommittee F. Final Report, June 10, 1960.)

EXAMPLE 2

Mechanical Diswasher Spotting and Filming Test

First the solid dishwasher detergent formulation is prepared by mixing the following components in the indicated amounts:

| COMPONENT | % BY WEIGHT |
|---|---|
| Surfactant | 2.0 |
| Sodium Silicate | 33.0 |
| Soda Ash Grade 100 | 15.0 |
| Anhydrous Sodium Sulfate | 28.0 |
| Sodium Tripolyphosphate | 20.0 |
| CLEARON CDB (chlorocyanurate) | 2.0 |

After this mixture is thoroughly mixed, it is stored in a tightly covered bottle until use.

Next a master batch of 20% dried milk and 80% warmed (melted) margarine are throughly mixed and then stored in a refrigerator. This mixture should not be stored longer than two weeks.

Six ten-inch dinner plates, six forks and six knives are then placed in the lower rack of a Kitchen Aid KDS-56 mechanical dishwasher. Eight 10 oz. glass tumblers (Federal glass No. 812 or Libby No. 53) are placed in the upper rack (four on each side).

The machine is then turned on and allowed to go through any prewash or rinse cycles. The temperature of the incoming water is adjusted to 130°±5°F.

When the dishwasher begins to fill for the main wash cycle, it is stopped and forty grams of the standard soil, prepared above, is smeared on the six dinner plates. Thirty grams of the test detergent is placed in machine detergent cup. The beakers which contained the soil and detergent are placed in the upper rack, the dishwasher is then restarted and allowed to complete the remaining wash, rinse and drying cycles.

When the drying cycle is complete, the machine is opened and allowed to cool. The tumblers are removed from the machine by the base being careful not to touch the sides. Each of the cooled tumblers is then rated for water spotting and filming according to the following rating system.

| RATING |
|---|
| 1 - Glass spotless |
| 2 - Spots at random or barely perceptible film. |
| 3 - One quarter of the glass is covered with spots or an apparent film. |
| 4 - The glass is completely covered with spots or heavy film. |

After the tumblers are rated they are returned to the machine (without further cleaning) and the above procedure repeated for a total of ten cycles or until a rating of five is achieved.

Upon completion of the test the tumblers are discarded.

The average over ten cycles is reported as the spotting and filming results shown in the Tables.

This Test is a standard test reported by CSMA (Laboratory Test Manual No 420) in *Soap and Chem Specialites,* September 1957.

EXAMPLE 3

Test for Active Chlorine Stability in Mechanical Dishwashing Formulations

Evaluation of active chlorine stability was done by blending 300 grams of 90% sodium tripolyphosphate (F.M.C. Corp), 5% Clearon CDB (F.M.C. Corp.) and 5% surfactant and weighed into 4 oz. wide mouth jars (50 grams each) for a total of 2 jars. The jars were then covered with Whatman No. 2 filter paper which was wired onto the bottle. Three of the jars were then placed into a Model 416 FAVORITE incubator (sold by Leahy Mfg. Co. of Higgginsville, Md.) at 100° F. and 70–71% humidity. The remaining three jars of blended surfactant are titrated iodometrically to obtain initial chloride content. This is done by taking four ten gram increments from each jar (a total of twelve) and titrating by the procedure described on page 597 of the "Textbook of Qualitative Inorganic Analysis" 3rd Ed. by Kalthoff and Sandel. This procedure is repeated after storing in the incubator for three weeks. The values are averaged and the ratio of $$\frac{\text{Concentration of active chlorine after 3 weeks}}{\text{Initial concentration of active chlorine}} \times 100$$

gives the percent active chlorine remaining after three weeks at 100° F. and about 70% humidity.

In the following tables, the data obtained are set forth for the comparison and evalation of a variety of polyether form control agents of the present invention with commercially available surfactants. The polyether foam control agents and the surfactants are identified respectively by number or letter which correspond to the following general structures set forth below:

STRUCTURE OF RANDOM POLYETHER COPOLYMER FOAM CONTROL AGENTS

| FOAM CONTROL AGENT | MOLECULAR WEIGHT | R | STRUCTURE $RO(C_3H_6O)_x(C_2H_4O)_yH$ x[1] | y[1] | BLOCK/ RANDOM[2] |
|---|---|---|---|---|---|
| 1 | 1000 | $C_{12}H_{25}$—$C_{14}H_{29}$ | 0.5 | 0.5 | random |
| 2 | 1000 | $C_4H_9$ | 0.5 | 0.5 | random |
| 3 | 1980 | $C_4H_9$ | 0.5 | 0.5 | random |

-continued

STRUCTURE OF RANDOM POLYETHER COPOLYMER FOAM CONTROL AGENTS

| FOAM CONTROL AGENT | MOLECULAR WEIGHT | R | STRUCTURE $RO(C_3H_6O)_x(C_2H_4O)_yH$ x[1] | y[1] | BLOCK/ RANDOM[2] |
|---|---|---|---|---|---|
| 4 | 3500 | $C_4H_9$ | 0.5 | 0.5 | random |
| 5 | 4400 | $C_4H_9$ | 0.5 | 0.5 | random |
| 6 | 360 | $C_4H_9$ | 1.0 | 0 | — |
| 7 | 650 | $C_4H_9$ | 1.0 | 0 | — |
| 8 | 1850 | $C_4H_9$ | 1.0 | 0 | — |
| 9 | 2600 | $C_4H_9$ | 1.0 | 0 | — |
| 10 | 2025 | (see note 3) | 1.0 | 0 | — |
| 11 | 4025 | (see note 3) | 1.0 | 0 | — |
| 12 | 4000 | H | 0.25 | 0.75 | random |
| 13 | 14,000 | H | 0.25 | 0.75 | random |
| 14 | 4500 | H | 0 | 1.0 | — |
| 15 | 4500 | H | 0.8 | 0.2 | random |
| 16 | 4000 | H | 0.25 | 0.75 | random |
| 17 | 4400 | $C_4H_9$ | 0.5 | 0.5 | random |
| 18 | 5800 | $C_4H_9$ | 0.4 | 0.6 | random |
| 19 | 5000 | $C_4H_9CH(C_2H_5)CH_2$ | 0.5 | 0.5 | random |
| 20 | 5000 | $C_4H_9CH(C_2H_5)CH_2$ | 0.62 | 0.38 | random |
| 21 | 8989 | H | 0.5 | 0.5 | random |
| 22 | 1800 | 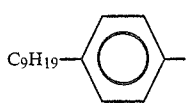 | 0.58 | 0.42 | random |
| 23 | 5100 | $C_{10}H_{21}$ | 0.5 | 0.5 | random |
| 24 | 4400 | $C_{18}H_{37}$ | 0.5 | 0.5 | random |
| 25 | 5800 | $C_{18}H_{37}$ | 0.5 | 0.5 | random |
| 26 | 5000 | $C_4H_9CH(C_2H_5)CH_2$ | 0.5 | 0.5 | random |
| 27 | 4700 | 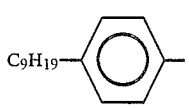 | 0.58 | 0.42 | random |
| 28 | 4200 | $C_{12}H_{25}—C_{14}H_{29}$ | 0.58 | 0.42 | random |

[1]x = weight fraction of the polyether component composed of propyleneoxy groups; y = weight fraction of ethyleneoxy groups.
[2]Block/random refers to the polyether sequencing. For 100 percent ethylene or propylene oxide composition this designation does not apply.
[3]This polymer is a glycerine started triol with the following nominal structure:

$$H(C_3H_6)_yOCH_2CH(O(C_3H_6O)_yH)CH_2O(C_3H_6O)_yH$$

STRUCTURE OF VARIOUS CONVENTIONAL BLOCK NONIONIC SURFACTANTS

| SURFACTANT | STRUCTURE |
|---|---|
| A | $RO(C_2H_4O)_4H$ where R = 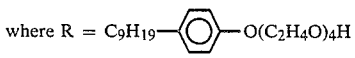 |
| B | $RO(C_2H_4O)_3(C_3H_6O)_{3.8}(C_2H_4O)_{5.1}H$ random where R = $CH_3(CH_2)_nCH(CH_2)_mCH_3$ (n + m) = 8–12 |
| C | $RO(C_3H_6O)_9(C_2H_4O)_6(C_3H_6O)_2H$ random where R = $CH_3CH_2CH_2CH_2CCH_2C_2H_5$ |

-continued

STRUCTURE OF VARIOUS CONVENTIONAL BLOCK NONIONIC SURFACTANTS

| SURFACTANT | STRUCTURE |
|---|---|
| D | 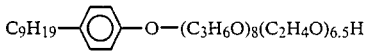 block |
| E | $HO(C_2H_4O)_x(C_3H_6O)_y(C_2H_4O)_zH$ block where x + z = 4.45 y = 27.6 |
| F | $HO(C_3H_6O)_x(C_2H_4O)_y(C_3H_6O)_zH$ block where x + z = 40.8 y = 14.8 |
| G | $C_9H_{19}O(C_2H_4O)_{10}(C_3H_6O)_{15}H$ |

-continued

| STRUCTURE OF VARIOUS CONVENTIONAL BLOCK NONIONIC SURFACTANTS | |
|---|---|
| SURFACTANT | STRUCTURE |
| H | block $C_{10}H_{21}O(C_2H_4O)_4(C_3H_6O)_8H$ block |

TABLE I

| EVALUATION OF A MECHANICAL DISHWASHER DETERGENT WITHOUT A SURFACTANT | |
|---|---|
| TEST | NO SURFACTANT |
| Dishwasher Foam Test[1] (ratio %) | 45 |
| Spotting and Filming index[2] | 3.4 (after 7 cycles) >7 cycles = 5 |

[1]The dishwasher foam test is described in Example 1.
[2]The spotting and filming test is described in Example 2.

TABLE II

EVALUATION OF THE EFFECT OF MOLECULAR WEIGHT AND ETHYLENE/PROPYLENE OXIDE CONTENT OF FOAM CONTROL AGENT ACTIVITY

| FOAM CONTROL AGENT | MOLECULAR WEIGHT | WT % E.O. | DISHWASHER FOAM TEST (RATIO %) |
|---|---|---|---|
| none | — | — | 45 |
| 1 | 1000 | 50 | 50 |
| 2 | 1000 | 50 | 34 |
| 3 | 1980 | 50 | 53 |
| 4 | 3500 | 50 | 85 |
| 5 | 4400 | 50 | 91 |
| 6 | 360 | 0 | 36 |
| 7 | 650 | 0 | 39 |
| 8 | 1850 | 0 | 67 |
| 9 | 2600 | 0 | 61 |
| 10 | 2025 | 0 | 68 |
| 11 | 4025 | 0 | 64 |
| 12 | 4000 | 75 | 33 |
| 13 | 14,000 | 75 | 37 |
| 14 | 4000 | 100 | 29 |
| 15 | 4500 | 20 | 73.9 |
| 16 | 4000 | 25 | 100 |
| 17 | 4400 | 50 | 91 |
| 18 | 5800 | 65 | 61 |
| 19 | 5000 | 50 | 100 |
| 20 | 5000 | 38 | 100 |

[1]The dishwasher foam test is described in Example 1.

TABLE III

EFFECT OF FOAM CONTROL AGENT MOLECULAR WEIGHT AND HYDROPHOBICITY OF SPOTTING AND FILMING PROPERTIES

| FOAM CONTROL AGENT | MOLECULAR WEIGHT | DISHWASHER FOAM TEST (RATIO %)[1] | SPOTTING AND FILMING INDEX[2] |
|---|---|---|---|
| none | — | 45 | 3.4 after 7 cycles >7 cycles = 5 |
| 8 | 1850 | 67 | 5.0 |
| 2 | 1000 | 34 | 5.0 |
| 3 | 1980 | 53 | 2.5 |
| 4 | 3500 | 85 | 2.0 |
| 5 | 4400 | 91 | 2.0 |

TABLE IV

EFFECT OF FOAM CONTROL AGENT CONCENTRATION ON DEFOAMANT ABILITY MECHANICAL DISHWASHER DETERGENT (MDD) FORMULATION

| COMPONENT | Run No. (Wt %) 1 | 2 | 3 |
|---|---|---|---|
| Foam control agent No. 5 | 5.0 | 2.0 | 1.0 |
| Sodium Metasilicate | 31.7 | 32.7 | 33.0 |
| Sodium Tripolyphosphate | 31.7 | 32.7 | 33.0 |
| Sodium Carbonate | 31.6 | 32.6 | 33.0 |
| Dishwasher Foam Test (Ratio %)[1] | 96 | 91 | 68 |

[1]The dishwasher foam test is described in Example 1.
[2]The spotting and filming index is described in Example 2.

TABLE V

EFFECT ON MDD PROPERTIES OF ESTERIFICATION OF HYDROXYL TERMINATED FOAM CONTROL AGENT

| FOAM CONTROL AGENT | TERMINAL FUNCTIONALITY[3] | DISHWASHER FOAM TEST (RATIO %)[1] | SPOTTING AND FILMINDEX[2] |
|---|---|---|---|
| 4 | hydroxyl | 85 | 2.0 |
| 4A | acetate | 92 | 1.9 |
| 5 | hydroxyl | 91 | 2.0 |
| 5A | methyl | 88 | 2.8 |
| 5B | acetate | 94 | 1.5 |
| 5C | butyrate | 94 | (not determined) |

[1]The dishwasher foam test is described in Example 1.
[2]The spotting and filming index is described in Example 2.
[3]The R group of the foam control agent structural formula: $RO(C_3H_6O)_x(C_2H_4O)_yH$ is butyl in agents 5A, 4A, 5B and 5C.

TABLE VI

COMPARATIVE EVALUATION OF FOAM CONTROL AGENTS WITH VARIOUS MDD SURFACTANTS HAVING BLOCK STRUCTURE

| FOAM CONTROL AGENT OR SURFACTANT | MOLECULAR WEIGHT | DISHWASHER FOAM TEST (RATIO %)[1] | SPOTTING AND FILMING INDEX[2] | BLOCK/RANDOM |
|---|---|---|---|---|
| None | — | 45 | 3.4 (after 7 cycles) >7 cylces = 5 | — |
| G | 1453 | 92 | 3.6 | block |
| H | 797 | 59 | 2.2 | block |
| F | 3120 | 95 | 2.5 | block |
| 5 | 4500 | 91 | 1.5 | random |
| 21 | 8989 | 88 | 2.6 | random |
| 22 | 1800 | 100 | 2.0 | random |
| 23 | 5100 | 92 | 2.1 | random |
| 24 | 4400 | 100 | 2.0 | random |
| 25 | 5800 | 100 | 1.6 | random |
| 26 | 5000 | 100 | 1.8 | random |
| 27 | 4700 | 100 | 1.4 | random |

TABLE VI-continued

COMPARATIVE EVALUATION OF FOAM CONTROL AGENTS WITH VARIOUS MDD SURFACTANTS HAVING BLOCK STRUCTURE

| FOAM CONTROL AGENT OR SURFACTANT | MOLECULAR WEIGHT | DISHWASHER FOAM TEST (RATIO %)[1] | SPOTTING AND FILMING INDEX[2] | BLOCK/ RANDOM |
|---|---|---|---|---|
| 28 | 4200 | 94 | 1.5 | random |

[1]The diswasher foam test is described in Example 1.
[2]The spotting and filming index is described in Example 2.

Although the invention has been illustrated by the preceding examples it is not to be construed as being limted to the materials employed therein, but rather, the invention encompasses the generic area as hereinbefore disclosed. Various modifications and embodiments thereof can be made without departing from the spirit or scope thereof.

What is claimed is:

1. A formulation for use in a mechanical dishwasher, said formulation having low foaming properites and which leaves a minimum of spotting and filming on articles washed in said mechanical dishwaser, said formuation containing a foam controlling amount of a copolyethers having a molecular weight of at least about 2000, and containing random ethyleneoxy groups, copolymerized with at least one other alkyleneoxy group selected from the group consisting of propyleneoxy and butyleneoxy groups, wherein said ethyleneoxy groups are present in an amount of at least about 20 percent by weight of the polyether component of said polyether, and wherein said polypropyleneoxy and butyleneoxy groups are present in an amount such that the cloud point of said foam control agent is no greater than the operating temperature of said mechanical dishwasher.

2. The mechanical dishwasher formulation of claim 1 wherein said copolyether foam control agent is selected from the group consisting of polyethers of the formulae:

$$RO(C_2H_4O)_x(\underset{\underset{R'}{|}}{CH_2CHO})_yX \qquad \text{I}$$

$$XO(C_2H_4O)_x(\underset{\underset{R'}{|}}{CH_2CHO})_y(\underset{\underset{R}{|}}{CH_2CHO})_zX \qquad \text{II}$$

$$ZO(\underset{\underset{\underset{Z}{|}}{O}}{CH_2CHCH_2O})_{w/2}[(C_2H_4O)_x(\underset{\underset{R'}{|}}{CH_2CHO})_y(\underset{\underset{R''}{|}}{CH_2CHO})_z]-(\underset{\underset{\underset{Z}{|}}{O}}{CH_2CHCH_2O})_{w/2}Z \qquad \text{III}$$

$$A(\underset{\underset{\underset{Z}{|}}{O}}{OCH_2CHCH_2OZ})_n \qquad \text{IV}$$

wherein R is derived from a saturated or unsaturated alcohol having up to 36 carbon atoms, or is an alkylaryl group; R′ is a methyl or ethyl group; R″ is an alkyl group having from 3 to 36 carbon atoms, or an alkylaryl group, x and y are integers selected in any ratio such that the final polyether does not contain more than 75 weight percent of ethylene oxide; z is an integer of from 0 to 4; X is hydrogen, chloro, alkyl of from 1 to 24 carbon atoms, alkylaryl, a beta-hydroxy alkyl group, an alkylcarbonyl group or an arylcarbonyl group; w has a value of from 2 to 40; Z is:

$$[O(C_2H_4O)_{x'}(\underset{\underset{R'}{|}}{CHCHO})_{y'}(\underset{\underset{R''}{|}}{CH_2CHO})_{z'}X]$$

wherein R′ and X are defined as above; x′ and y′ are integers selected such that the sums of (x′+x) and (y′+y) are such that the polyether does not contain more than 75 percent by weight of ethylene oxide; z′ is an integer of from 0 to 15; A is the residue of an alcohol having a hydroxy functionality of from 1 to 6; and n is integer of from 1 to 6.

3. The mechanical dishwasher formulation of claim 2 wherein the copolyether has the formula I:

$$RO(C_2H_4O)_x(\underset{\underset{R'}{|}}{CH_2CHO})_yX$$

wherein R is derived from a saturated or unsaturated alcohol having up to 36 carbon atoms or is an alkylaryl group; R′ is methyl or ethyl; x and y are integers selected in any ratio such that the final polyether does not contain more than 75 percent by weight of ethylene oxide; and X is hydrogen, chloro alkyl of from 1 to 24 carbon atoms, alkylaryl, alkylcarbonyl, arylcarbonyl, or a beta-hydroxy alkyl group.

4. The mechanical dishwasher formulation of claim 3, wherien X is hydrogen, R is derived from a $C_{12}$ to $C_{18}$ primary alcohol or nonylphenol, R′ is methyl, the ratio of x to y ranges from about 40:60 to 50:50, and the molecular weight is at least about 4000.

5. The mechanical dishwasher formulation of claim 3, wherein X is hydrogen, R is a $C_{18}H_{37}$ alkyl group, R′ is methyl, the ratio of x to y is about 50:50, and the molecular weight is about 5800.

6. The mechanical dishwasher formulation of claim 3, wherein X is hydrogen, R is derived from nonyl phenol;

R′ is methyl, the ratio of x to y is about 58:42, and the molecular weight is 4700.

7. The mechanical dishwasher formulation of claim 3, wherein X is hydrogen, R is $C_{12}H_{25}$–$C_{14}H_{29}$ alkyl, R′ is methyl, the ratio of x to y is 58:42, and the molecular weight is 4200.

8. The mechanical dishwasher formulation of claim 1, wherein the copolyether has the formula II:

$$XO(C_2H_4O)_x(CH_2\underset{\underset{R'}{|}}{C}HO)_y(CH_2\underset{\underset{R}{|}}{C}HO)_zX \qquad \text{II}$$

wherein R′ is methyl or ethyl; R is an alkyl group having up to 36 carbon atoms or an alkylaryl group; x and y are intergers selected in any ratio such that the final polyether does not contain more than 75 percent by weight of ethylene oxide; z is an interger of from 0 to 4; and X is hydrogen, chloro, alkyl of 1 to 24 carbon atoms, alkylaryl, alkylcarbonyl, arylcarbonyl or beta-hydroxy alkyl.

9. The mechanical dishwasher formulation of claim 8, wherein X is hydrogen, R is derived from a $C_{12}$ to $C_{18}$ primary alcohol or nonyl phenol, z is 1 to 2, and the molecular weight is at least 4000.

10. The mechanical dishwasher formulation of claim 2, wherein the copolyether has the formula III:

$$ZO(CH_2\underset{\underset{Z}{|}}{\overset{\overset{O}{|}}{C}}HCH_2O)_{w/2}[(C_2H_4O)_x(CH_2\underset{\underset{R'}{|}}{C}HO)_y(CH_2\underset{\underset{R''}{|}}{C}HO)_z]-(CH_2\underset{\underset{Z}{|}}{\overset{\overset{O}{|}}{C}}HCH_2O)_{w/2}Z \qquad \text{III}$$

wherein Z, w, x, y, z, R′ and R″ are as defined above.

11. The mechanical dishwasher formulation of claim 2, wherein the copolyether has the formula IV:

$$A(OCH_2\underset{\underset{Z}{|}}{\overset{\overset{O}{|}}{C}}HCH_2OZ)_n \qquad \text{IV}$$

wherein A, Z and n are as defined above.

12. The mechanical dishwasher formulation of claims 1, 2, 3, 8, 10 or 11 wherein the ethyleneoxy group content and the propyleneoxy or butyleneoxy group content of said copolyether is selected such that the cloud point of the copolyether is equal to or less than the operating temperature of the dishwasher, and the ethyleneoxy group content is within the range of from 20 to 60 weight percent.

13. The mechanical dishwasher formulation of claim 12, wherein said random copolyether has a molecular weight of from about 4500 to about 30,000.

14. The mechanical dishwasher formulation of claim 12, wherein said formulation is a mechanical dishwasher detergent.

15. The mechanical dishwasher formulation of claim 12, wherein said formulation is a mechanical dishwasher detergent containing from about 1 to 5 percent by weight of said copolyether.

16. The mechanical dishwasher formulation of claim 12, wherein said formulation is a rinse.

17. A mechanical dishwasher detergent comprising:

(a) from about 90 to 95 weight percent of at least one builder;

(b) from about 0.5 to about 5.0 weight percent of a compound which liberates active chlorine; and (c) from about 1 to about 5 weight percent of a copolyether foam control weight selected from the group consisting of polyethers of the formulae:

$$RO(C_2H_4O)_x(CH_2\underset{\underset{R'}{|}}{C}HO)_yX \qquad \text{I}$$

$$XO(C_2H_4O)_x(CH_2\underset{\underset{R'}{|}}{C}HO)_y(CH_2\underset{\underset{R}{|}}{C}HO)_zX \qquad \text{II}$$

$$ZO(CH_2\underset{\underset{Z}{|}}{\overset{\overset{O}{|}}{C}}HCH_2O)_{w/2}[(C_2H_4O)_x(CH_2\underset{\underset{R'}{|}}{C}HO)_y(CH_2\underset{\underset{R''}{|}}{C}HO)_z]-(CH_2\underset{\underset{Z}{|}}{\overset{\overset{O}{|}}{C}}HCH_2O)_{w/2}Z \qquad \text{III}$$

$$A(OCH_2\underset{\underset{Z}{|}}{\overset{\overset{O}{|}}{C}}HCH_2OZ)_n \qquad \text{IV}$$

wherein R is derived from a saturated or unsaturated alcohol having up to 36 carbon atoms, or is an alkylaryl group; R′ is a methyl or ehtyl group; R″ is an alkyl group having from 3 to 36 carbon atoms, or an alkylaryl group; x and y are integers selected in any ratio such that the final polyether does not contain more than 75 weight percent of ethylene oxide; z is an integer of from 0 to 4; X is hydrogen, chloro, alkyl of from 1 to 24 carbon atoms, alkylaryl, a beta-hydroxy alkyl group, an alkylcarbonyl group or an arylcarbonyl group; w has a value of from 2 to 40; Z is:

$$[O(C_2H_4O)_{x'}(CH\underset{\underset{R'}{|}}{C}HO)_{y'}(CH_2\underset{\underset{R''}{|}}{C}HO)_{z'}X]$$

wherein R′ and X are defined as above; x′ and y′ are integers selected such that the sums of (x′+x) and (y′+y) are such that the polyether does not contain more than 75 percent by weight of ethylene oxide; z′ is an integer of from 0 to 15; A is the residue of an alcohol having a hydroxy functionality of from 1 to 6; and n is integer of from 1 to 6; provided that when R is other than an alkylaryl group, then the molecular weight of the copolyether is at least about 2000.

18. The mechanical dishwasher detergent of claim 17, wherein the ethyleneoxy group content and the propyleneoxy or butyleneoxy group content of said copolyether is selected such that the cloud point of the copolyether is equal to or less than the operating temperature of the dishwasher, and the ethyleneoxy group content is within the range of from 20 to 60 weight percent.

19. The mechanical dishwasher detergent of claim 18, wherein said random copolyether has a molecular weight of from about 4500 to about 30,000.

20. The mechanical dishwasher detergent of claim 19, wherein said copolyether has the formula I:

$$RO(C_2H_4O)_x(CH_2\underset{\underset{R'}{|}}{C}HO)_yX$$

wherein R, X, R', x and y are as defined above.

21. The mechanical dishwasher detergent of claim 19, wherein said copolyether has the formula II:

$$XO(C_2H_4O)_x(CH_2\underset{\underset{R'}{|}}{C}HO)_y(CH_2\underset{\underset{R}{|}}{C}HO)_zX$$

wherein X, R', R, x, y and z are as defined above.

22. The mechanical dishwasher formulation of claim 18, wherein the amount of ethyleneoxy and propyleneoxy or butyleneoxy groups present in said copolyether are selected such that the cloud point of said foam control agent is less than about 170° F.

23. The mechanical dishwasher detergent of claim 18, wherein wherein the amount of ethyleneoxy and propyleneoxy or butyleneoxy groups present in said copolyether are selected such that the cloud point of said foam control agent is less than about 160° F.

24. The mechanical dishwasher detergent of claim 18, wherein the amount of ehtyleneoxy and propyleneoxy or butyleneoxy groups present in said copolyether are selected such that the cloud point of said foam control agent is less than about 140° F.

25. The mechanical dishwasher detergent of claim 20, wherein X is hydrogen, R is derived from a $C_{12}$ to $C_{18}$ primary alcohol or nonylphenol, R' is methyl, the ratio of x to y ranges from about 40:60 to 50:50, and the molecular weight is at least about 4500.

26. The mechanical dishwasher detergent of claim 20, wherein X is hydrogen, R is a $C_{18}H_{37}$ alky group, R' is methyl, the ratio of x to y is about 50:50, and the molecular weight is about 5800.

27. The mechanical dishwasher detergent of claim 20, wherein X is hydrogen, R is derived from nonyl phenol; R' is methyl, the ratio of x to y is about 58:42, and the molecular weight is about 4700.

28. The mechanical dishwasher detergent of claim 34, wherein X is hydrogen, R is $C_{12}H_{25}$–$C_{14}H_{29}$ alkyl, R' is methyl, the ratio of x to y is 58:42, and the molecular weight is 4200.

29. The mechanical diswasher detergent of claim 21, wherein X is hydrogen, R is derived from a $C_{12}$ to $C_{18}$ primary alcohol or nonyl phenol, z is 1 to 2, and the molecular weight is at least 4500.

* * * * *